US006810637B2

(12) United States Patent
Weber

(10) Patent No.: US 6,810,637 B2
(45) Date of Patent: Nov. 2, 2004

(54) SLICING AND CONVEYING DEVICE FOR FOOD PRODUCTS

(75) Inventor: Günther Weber, Zachow (DE)

(73) Assignee: Weber Maschinenbau GmbH & Co., KG, Breidenbach (DE)

( * ) Notice: Subject to any disclaimer, the term of this patent is extended or adjusted under 35 U.S.C. 154(b) by 0 days.

(21) Appl. No.: 10/380,011

(22) PCT Filed: Aug. 22, 2001

(86) PCT No.: PCT/EP01/09709

§ 371 (c)(1),
(2), (4) Date: Apr. 1, 2003

(87) PCT Pub. No.: WO02/22446

PCT Pub. Date: Mar. 21, 2002

(65) Prior Publication Data

US 2003/0167738 A1 Sep. 11, 2003

(30) Foreign Application Priority Data

Sep. 12, 2000 (DE) ..... 100 45 055

(51) Int. Cl.[7] ..... B65B 3/04
(52) U.S. Cl. ..... 53/260; 53/517
(58) Field of Search ..... 53/244, 245, 260, 53/157, 517, 518, 534; 198/578

(56) References Cited

U.S. PATENT DOCUMENTS

| | | | | | |
|---|---|---|---|---|---|
| 3,010,499 | A | * | 11/1961 | Dahms et al. | 53/517 |
| 3,183,642 | A | * | 5/1965 | Tindall | 53/517 |
| 3,567,047 | A | * | 3/1971 | Clausen et al. | 198/578 |
| 3,655,024 | A | * | 4/1972 | Horn | 198/578 |
| 3,804,228 | A | * | 4/1974 | Felstehausen | 198/431 |
| 3,846,958 | A | * | 11/1974 | Divan | 53/517 |
| 4,608,808 | A | * | 9/1986 | Ryan et al. | 53/260 |
| 4,644,729 | A | * | 2/1987 | Fessler | 53/157 |
| 5,328,709 | A | * | 7/1994 | Larsen | 426/502 |
| 6,182,424 | B1 | * | 2/2001 | Mahood et al. | 53/260 |
| 6,224,363 | B1 | * | 5/2001 | Mahan et al. | 198/346.2 |

FOREIGN PATENT DOCUMENTS

| | | |
|---|---|---|
| DE | 2154733 | 5/1973 |
| DE | 2413711 | 6/1976 |
| DE | 3612996 | 10/1987 |
| DE | 4308309 | 9/1994 |
| DE | 4429327 | 2/1996 |
| DE | 19837645 | 2/2000 |
| DE | 19713813 | 11/2000 |
| EP | 0107056 | 4/1986 |
| FR | 1545954 | 11/1958 |
| NL | 8205077 | 7/1984 |

* cited by examiner

*Primary Examiner*—Louis Huynh
(74) *Attorney, Agent, or Firm*—Gifford, Krass, Groh, Sprinkle, Anderson & Citkowski, P.C.

(57) ABSTRACT

The invention relates to a device for slicing food products and for conveying portions of a plurality of imbricated or stacked slices of the product, comprising a slicing device and an additional processing unit arranged below the slicing device, especially a packaging machine, in addition to a transfer device which is arranged between the slicing device and the processing unit whereby portions are transferred to the transfer device from the slicing machine and from there said portions are transported to the packaging machine. The transfer device comprises a product support with at least one substantially horizontally extending support area for at least one respective portion which is to be transported. The support product can move in synch with a portion coming from the slicing machine in order to receive said portion and can move away, underneath said portion, in a series of jerks and bolts in order to deliver the received portion in a lying position from a transfer position wherein the portion is located above a product-receiving element in the processing machine.

13 Claims, 1 Drawing Sheet

SLICING AND CONVEYING DEVICE FOR FOOD PRODUCTS

BACKGROUND OF THE INVENTION

1. Field of the Invention

The invention relates to an apparatus for the slicing of food products and for the onward transport of portions of a plurality of product slices arranged in a overlapping or stacked manner.

2. Description of the Related Art

In such apparatuses, the risk exists that the structure of the portions is disturbed in the onward transport, in particular to a further processing unit, which is disposed downstream of the slicing unit also termed a slicer. In known apparatuses, the onward transport of the portions is realized in connection with the onward transport, and in particular with the transfer of portions to a processing unit disposed downstream of a slicing unit, with a comparatively large design effort, for example in that excess belt lengths of transport belts are taken up by means of one or more compensation rolls. This does not only mean a disadvantageous additional effort, but also increases the proneness of the apparatus to disturbance.

It is the object of the invention to provide an apparatus of the kind first mentioned with which portions of sliced product slices arranged in an overlapping or stacked manner can be transported onward with the lowest possible disturbance of the portion structure formed on the overlapping or stacking, and can in particular be transferred to a further processing unit, with this in particular being possible with a low construction effort and without increasing the proneness to disturbance of the apparatus and without the operating routine and the operating speed of the apparatus being impaired.

SUMMARY OF THE INVENTION

This object is satisfied by the features of claim 1 and in particular in that a transfer unit is arranged between a slicing unit and a further processing unit, in particular a packaging machine, arranged beneath the slicing unit and the portions can be transferred to it from the slicing unit and the portions can be transferred from it to the processing unit, with the transfer unit comprising a product support having an at least substantially horizontally extending support surface for, in each case, at least one portion to be transferred, and with the product support being movable—for the acceptance of a portion coming from the slicing unit—synchronously with the portion and being movable away with the portion lying on it in an abrupt like manner under the portion for the dispensing of the received portion from a transfer position in which the portion is located above a product receiver of the processing unit.

In accordance with the invention, the portions are each dropped into the product receiver, whereby the portion structure is not disturbed. The abrupt moving away of the product support means that the portions, in a certain manner, "have the ground pulled out from underneath them" and it is thus ensured that the relative position of the individual product slices is not changed by interactions between the support surface and the product slices contacting the support surface.

The sudden moving away of the product support in accordance with the invention can be compared with the pulling away of a tablecloth, where—pre-supposing a sufficiently high pulling-away speed—crockery previously standing on the table remains in place without changing its position in the plane of the table. The portions which, in accordance with the invention, are robbed of their support from one moment to the next—like the crockery standing on the table—remain in their original horizontal position and subsequently carry out only a falling movement into the product receiver.

The synchronization in accordance with the invention between the movement of the product support and the portions transported by the slicing unit ensures that, on the acceptance of the portions, their structure formed at the slicing unit is also maintained in unchanged form.

The product support can preferably be moved away by a movement of the transfer unit extending substantially horizontally. The horizontal movability of the product support has the advantage that no space is needed beneath the product support as is e.g. the case with an apparatus which can be flapped down or which can be pivoted downward. The height of drop for the portions robbed of their support can be minimized in this manner.

In accordance with a preferred practical aspect of the invention, the transfer unit includes an endless belt guided over deflection rolls as the product support. For the dispensing of a portion lying on the upper run of the endless band, the deflection rolls are preferably abruptly moved away in the substantially horizontal direction.

The support surface of the transfer unit is here formed by the upper run of the endless belt also designated as a belt band. An endless belt moreover makes it possible to abruptly remove the support of the portions abruptly in a particularly advantageous manner which is described in the following.

In accordance with a particularly preferred embodiment of the invention, a holding device is namely associated with the transfer unit and the upper run of the endless belt can be fixed by said holding device with respect to the direction of moving away in particular by clamping at a position disposed behind the supported portion in the direction of moving away.

The support surface formed by the upper run of the endless belt is hereby not disposed in parallel as a whole. The endless belt rather rolls away under the portion. The transfer unit can thus be designated as a dispenser from which the portions are rolled off, and indeed without a relative movement taking place in the plane of the support surface between the upper run of the endless belt and the supported product slices.

In accordance with a further preferred embodiment of the invention, the upper run of the endless belt is supported by a support member arranged between the upper run and the lower run.

The support member is preferably connected to the deflection rolls and can be coupled to an actuation device for the carrying out of the movement away from the product support.

A stable support for the portions lying on the upper run of the endless belt is present with the support member which is preferably provided in the form of a sheet metal support. The support member can thus ensure an optimum horizontal alignment of the portions. At the same time, due to is coupling to the deflection rolls, the support member serves as an actuation member at which a drive device can act in order to move the deflection rolls out of the transfer position.

The moving away speed of the deflection rolls preferably amounts to some m/s, with the speed preferably lying in a range from approximately 1 to 4 m/s, in particular preferably from approximately 2 to 3 m/s. In practice, a speed value of approximately 2.5 m/s has proved to be particularly suitable.

A further embodiment of the invention is characterized in that the transfer unit can be moved in an approximately horizontal direction for the acceptance of a portion as a whole, and in particular with an endless belt which is stationary with respect to the deflection rolls, synchronously with a portion coming from the slicing apparatus.

The transfer unit is thus moved as a whole in each case for the reception of the individual portions, with it preferably being provided that, as soon as the respective portion lies completely on the endless belt, the transfer unit is already located in the transfer position in which the portion is above the product receiver of the processing machine. The transfer unit is preferably already moved directly into that position from which it is again moved back abruptly for the transfer of the received portion to the processing unit on the receiving of a portion. The transfer unit can consequently be periodically moved to and fro between the transfer position and the retracted position, with the movement into the transfer position taking place comparatively slowly in accordance with the speed at which the portions are successively led on in the manner pre-set by the operating cycle of the apparatus, while the return movement from the transfer position takes place at a comparatively high speed.

BRIEF DESCRIPTION OF THE DRAWINGS

Advantages of the present invention will be readily appreciated as the same becomes better understood by reference to the following detailed description when considered in connection with the accompanying drawings, wherein.

DETAILED DESCRIPTION OF THE INVENTION

Figure 1:
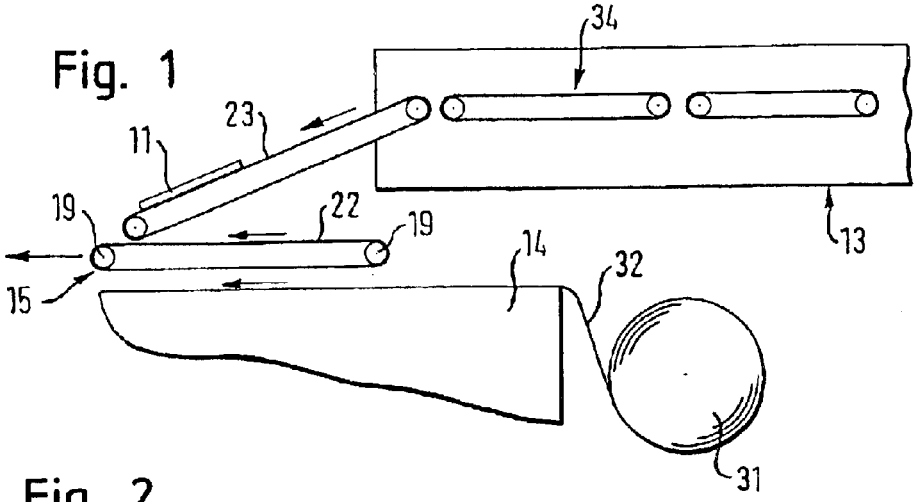
FIG. 1 a part of the apparatus in accordance with the invention in a schematic side view.

FIG. 1, which provides an overview of the apparatus in accordance with the invention, shows a part of a slicing unit 13, namely a slicer for the slice-ways cutting up of food products such as sausage, ham or cheese, as well as a part of a further processing unit 14, namely a packaging machine having a packaging film 32 wound on a supply drum 31, arranged beneath the slicer 13. The design of the slicer 13 and of the packaging machine 14 can generally be of any desired type and will only be dealt with in the following insofar as it is necessary for the understanding of the invention.

In accordance with the invention, a transfer unit 15 is arranged between the slicing unit 13 and the packaging machine 14 and its design and manner of function will be described in more detail in the following. The transfer unit 15 serves to transfer portions 11 of sliced product slices, arranged in an overlapping or stacked manner the packaging machine 14 such that the structure of the portions 11, i.e. the relative position of the product slices within the portions 11, is not changed in each case.

For this purpose, the slicing unit 13 has a so-called feeder 34 which includes a plurality of transport belts for the conveying of the portions 11 from the slicing position to a transfer device 23. The transfer device 23 is a transport belt inclined with respect to the horizontal whose lower end terminates just above the transfer unit 15 and with which the difference in height between an operating level of the slicing unit 13 defined by the feeder 34 and the transfer unit 15 is bridged for the transfer of the portions 11.

A portion 11 is shown in FIG. 1 as it is just being transported by means of the transfer device 23 of the slicer 13 in the direction of the transfer unit 15 arranged between the slicer 13 and the packaging machine 14.

The transfer unit 15 includes an endless belt 22, also designated as a belt band, which is guided over deflection rolls 19. The deflection rolls 19 are supported in a freely rotatable manner. Furthermore, the defection rolls 19 can be moved together in a horizontal direction and are, for this purpose, attached to a common carrier (not shown), which can be moved to and fro in a horizontal direction. The deflection rolls 19, or the aforesaid carrier, are coupled for this purpose, via an actuation device (not shown), to a corresponding drive—likewise not shown. The transfer unit 15 can thus be moved horizontally as a whole.

The drive for the horizontal movement of the transfer unit 15 and the drive of the transfer device 23 are synchronized with one another such that the speed of the upper run of the endless belt 22 is the same as the horizontal component of the speed the portion 11 coming from the transfer device 23. The portion 11 is thereby placed cleanly on the upper run of the endless belt 22 such that the structure of the portion 11 is not disturbed by relative movements between the endless belt 22 and the product slices coming into contact with the upper run.

Figure 2:
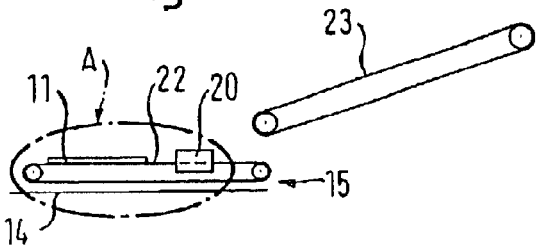
FIG. 2 a part of FIG. 1 which a portion lying on the transfer unit as well as an enlarged representation of detail A.
Figure 2:
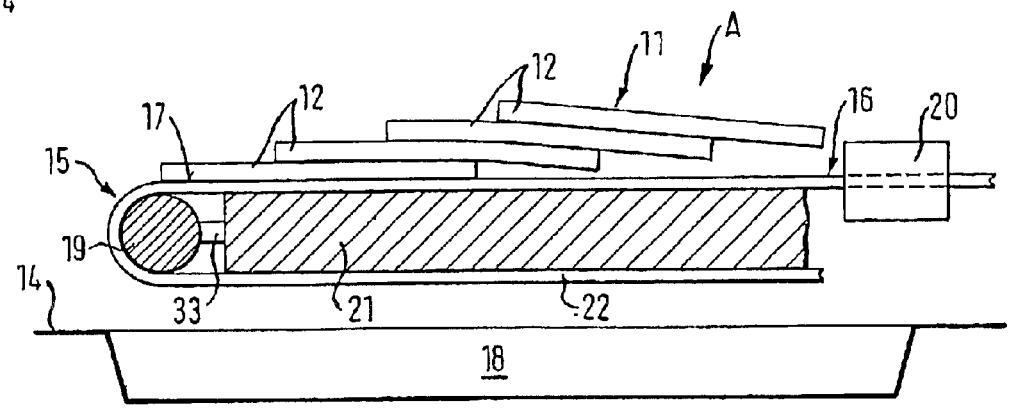

The small overview representation in FIG. 2 shows the transfer unit 15 in a transfer position in which a portion 11 lies completely on the upper run of the endless belt 22, with the endless belt 22 being designed such that the full area of the portion 11 lies on it, i.e. it is an endless belt 22 free of holes.

Furthermore, a holding device 20 is provided which is fixed to the machine, is stationary, at least in the horizontal direction, relative to the slicer 13 and to the packaging machine 14 and whose purpose will be described in more detail in the following.

The enlarged detail representation A of FIG. 2 shows the overlapping-like structure of the portion 11 including a plurality of product slices 12. Furthermore, a support member 21 is shown between the upper run and the lower run of the endless belt 22 provided in the form of a sheet metal support with which the upper run of the endless belt 22 is supported. The sheet metal support 21 is fixedly connected to the deflection rolls 19 or to the aforesaid carrier, to which the deflection rolls 19 are attached. A corresponding connection member 33 is indicated in FIG. 2.

The sheet metal support 21 has a thickness of preferably approximately 3 mm which is smaller than the diameter of the deflection rolls 19. The hatched area in FIG. 2 is an angled side area of the sheet metal support 21. Furthermore, the sheet metal support 21 is coupled to the horizontal drive via the aforesaid actuation device such that the sheet metal support 21—and with the sheet metal support 21 the deflection rolls 19—can be moved to and fro in the horizontal direction.

The detail representation A in FIG. 2 also shows the holding device 20 which can cooperate with the upper run of the endless belt 22. In a passive state of the holding device 20, the endless belt 22 can be moved in the horizontal direction uninfluenced by the holding device 20. The holding device is located in this passive state as long as the transfer unit 15 in accordance with FIG. 1 is moved from a starting position into the transfer position in accordance with FIG. 2. This transfer position is characterized in that the portion 11 is arranged precisely above a product receiver 18 of the only indicated packaging machine 14.

To transfer the portion 11 without disturbance of its structure, i.e. without any change in the relative position of the product slices 12 forming the portion 11, to the packaging machine 14, i.e. to supply it into the product receiver 18, the holding device 20 is initially set into an active state. In this active state, the upper run of the endless belt 22 is fixed at a position disposed behind the portion 11. For this purpose, the holding device 20 can be provided e.g. with a clamping device which includes, for example, two clamping jaws and with which the upper run of the endless belt 22 is fixedly clamped in the active state of the holding device 20 and is thus fixedly fixed to the machine.

Following this local fixing of the upper run of the endless belt 22, the sheet metal support 21 is moved abruptly to the right in a horizontal direction in FIG. 2 via the actuation device by means of the aforesaid drive. The deflection rolls 19 connected to the sheet metal support 21 hereby likewise move abruptly into this direction.

Figure 3:
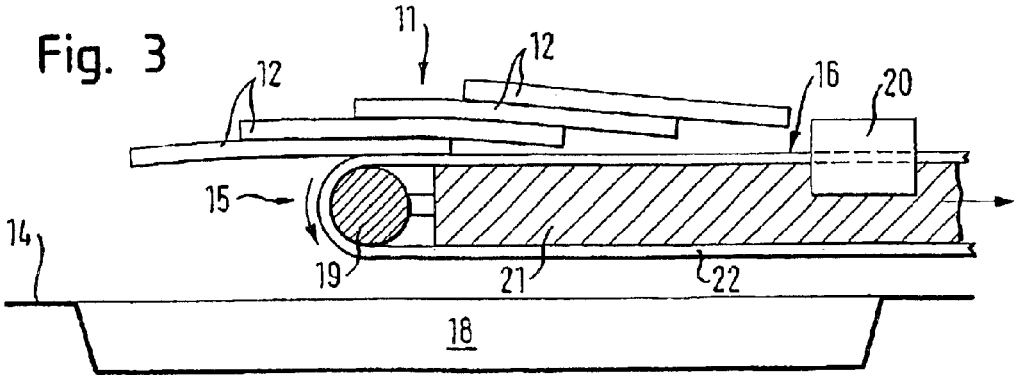
FIG. 3 a view corresponding to detail A of FIG. 2 with a partly moved back transfer unit.

FIG. 3 shows an intermediate position in which the transfer unit 15 has left the transfer position in accordance with FIG. 2, but has not yet reached the starting position in accordance with FIG. 1. The horizontal movement of the freely rotatable deflection rolls 19 with a locally fixed upper run of the endless belt 22 has the consequence that the deflection rolls 19 are set into rotation and the lower run and the part of the upper run disposed to the left of the holding device 20 in FIG. 2 and serving as the support for the portion 11 in the transfer position in accordance with FIG. 2 are moved away under the portion 11.

The portion 11 has "the ground pulled away from beneath it" abruptly, i.e. the portion 11 is suddenly robbed of its support, by the sudden pulling away movement of the transfer unit 15 at high speed, with the taking away of the product support 16 taking place without a horizontal relative movement between the support surface 17 and the product slices 12, since those regions of the upper run which contact the product slices 12 are not displaced horizontally, but come out of contact with the product slices 12 in that these support regions roll off on the deflection roll 19 moving away on the left hand side in FIG. 3 and thus move downwardly.

Considered from a reference system stationary with respect to the sheet metal support 21, the portion 11 is thus rolled off from the transfer unit 15 when this is pulled away.

The pulling away speed of the transfer unit 15 is higher than the speed at which the transfer unit 15 is moved into the transfer position synchronously in each case with the portions 11 coming from the transfer device 23 and preferably amounts to approximately 2.5 m/s. This speed can also be higher or lower depending on the respective circumstances.

The movement from the transfer position takes place so fast that all the product slices 12 forming the respective portion 11 practically start to fall vertically downwardly into the product receiver 18 of the packaging machine 14 at the same time.

The invention has been described in an illustrative manner. It is, therefore, to be understood that the terminology used is intended to be in the nature of words of description rather than of limitation. Many modifications and variations of the invention are possible in light of the above teachings. Thus, within the scope of the appended claims, the invention may be practiced other as specifically described.

What is claimed is:

1. An apparatus for the slicing of food products and for the onward transport of portions (11) of a plurality of product slices (12) arranged in an overlapping or stacked manner, comprising a slicing unit (13) and a further processing unit (14), arranged beneath the slicing unit (13); and comprising a transfer unit (15) which is arranged between the slicing unit (13) and the processing unit (14) and to which the portions (11) are transferred from the slicing unit (13) and from which the portions are transferred to the processing unit (14), wherein the transfer unit (15) comprises a product support (16) having an at least substantially horizontally extending support surface (17) for at least one portion (11) to be transferred; and wherein the product support (16) is movable to and away from a transfer position in which the portion (11) is located above a product receiver (18), the product support (16) being synchronously movable with a portion (11) coming from the slicing unit (13) for the acceptance of the portion (11) on the support surface (17) and, with the portion (11) lying on the support surface (17), being movable abruptly away from the transfer position, such that the support surface (17) is abruptly displaced away from under the portion (11) for the dispensing of the received portion (11) onto the product receiver (18), without relative movement between the support surface (17) and the portion (11) in the plane of the support surface (17).

2. An apparatus in accordance with claim 1, characterized in that the product support (16) is movable away by a substantially horizontally extending movement of the transfer unit (15).

3. An apparatus in accordance with claim 1, characterized in that the product support (16) includes an endless belt (22) guided over deflection rolls (19) and forming the support surface (17), with the deflection rolls (19) movable away abruptly in the substantially horizontal direction for the dispensing of a portion (11) lying on the upper run of the endless belt (22).

4. An apparatus in accordance with claim 3, characterized in that a holding unit (20) is associated with the transfer unit (15), whereby the upper run of the endless belt (22) can be fixed relative to the moving away direction at a position disposed behind the supported portion (11) in the moving away direction.

5. An apparatus in accordance with claim 4, wherein the upper run of the endless belt (22) is fixed by clamping by the holding unit (20) relative to the moving away direction at a position disposed behind the supported portion (11) in the moving away direction.

6. An apparatus in accordance with claim 3, characterized in that the upper run of the endless belt (22) is supported by a support member (21) arranged between the upper run and the lower run.

7. An apparatus in accordance with claim 6, characterized in that the support member (21) is connected to the deflection rolls (19) and is coupled to an actuation device for the carrying out of the away movement.

8. An apparatus in accordance with claim 6, characterized in that a sheet metal support (21) is provided as the support member, preferably with a thickness of some millimeters, which is angled at at least one side extending approximately in parallel to the endless belt (22).

9. An apparatus in accordance with claim 3, characterized in that the endless belt (22) is designed such that the full area of each portion (11) lies on the upper run.

10. An apparatus in accordance with claim 1, characterized in that the moving away speed of the product support (16) ranges between 1 to 4 m/s .

11. An apparatus in accordance with claim 1, characterized in that the transfer unit (15) can be moved in an approximately horizontal position synchronously with a portion (11) coming from the slicing unit (13) for the acceptance of the portion (11) as a whole and with an endless belt (22) stationary with respect to deflection rolls (19).

12. An apparatus in accordance with claim 1, characterized in that the slicing unit (13) has a transfer device (23) in the form of a pivotal conveyor belt which extends at an incline at least on the transfer of a portion (11) for the bridging of the difference in height between an operating plane of the slicing unit (13) and the support surface (17) of the transfer unit (15).

13. An apparatus in accordance with claim 1 wherein the processing unit (14) includes a packaging machine.

* * * * *